US005199781A

United States Patent [19]

Sweeny

[11] Patent Number: 5,199,781

[45] Date of Patent: Apr. 6, 1993

[54] ELECTRIC CANDLE HOLDER

[76] Inventor: John E. Sweeny, 301 Williamsburg Ct., Marlton, N.J. 08053

[21] Appl. No.: 957,830

[22] Filed: Oct. 6, 1992

[51] Int. Cl.[5] ..... F21P 1/02; F21Y 35/00

[52] U.S. Cl. ..... 362/145; 362/392; 362/810

[58] Field of Search ..... 362/145, 382, 392, 393, 362/810

[56] References Cited

U.S. PATENT DOCUMENTS

| | | | |
|---|---|---|---|
| 1,838,734 | 12/1931 | Beecher | 362/392 |
| 2,499,731 | 3/1950 | Derington | 362/125 |
| 4,392,191 | 7/1983 | White, Sr. | 362/392 |
| 4,468,721 | 8/1984 | Vandrilla | 362/392 |
| 4,839,784 | 6/1989 | Lin | 362/810 |

*Primary Examiner*—Richard R. Cole
*Attorney, Agent, or Firm*—Norman E. Lehrer

[57] ABSTRACT

A holding device for supporting an electric candle for viewing through a window. The holding device is comprised of a horizontally extending support base, having retaining hooks for securing an electric candle, a vertically extending wall attached to the support base, and a handle for attaching to a window sash which interacts with the wall and connects the support base and candle to the window. The candle end of the support base accommodates force fitting hooks for holding the candle while the opposite end abuts the window sash. The handle is attached to the window sash and extends upwardly and outwardly at an angle leaving a space between the window and handle for grasping. The wall is located on the support base at a distance from the end of the base which abuts the window equal to the horizontal measurement of the space between the window and the handle. The support base and candle are connected to the handle and window by placing the wall against the inside surface of the handle while the support abuts the window sash.

15 Claims, 2 Drawing Sheets

ELECTRIC CANDLE HOLDER

BACKGROUND OF THE INVENTION

This invention relates to electric candles, and more particularly to a device for supporting an electric candle in a window for visual access.

Electric candles are used for their aesthetic appeal and most particularly are used around the winter holidays for decoration. The common method of use for the candles is to place them in windows for viewing from the outside of the home. The candles are generally placed on the window sill. The reason for this invention arises when various types of candles must be maintained on a variety of window sills. Due in part to the awkward effect of the electric cord, the candles are difficult to secure to the window in an upright fashion. Taping the candle base and/or the cord to the window sill or stapling the cord to the sill are ineffective methods that have been tried that usually cause unwanted amplification of holiday stress.

There are known in the prior art electric candle holders but none combine all the features of the instant invention for as many types of windows or candles. U.S. Pat. No. 2,499,731 to Derington, for example, shows a bent wire which fits around the edge of a window sill and extends vertically therefrom. The extending end is used for holding the electric candle. The support is applicable to a particular type of candle which slides on the wire end and can be used with only certain types of window sills.

U.S. Pat. No. 4,392,191 to White shows a support and candle assembly. The support comprises an L-shaped member having a loop on one end for holding the candle in place, and a wedge type insert on the other end for inserting between the sill and the window sash for securing the support. The insert must be proper in size to fit between the window sill and sash.

U.S. Pat. No. 4,468,721 to Vandrilla shows a candle assembly incorporating a leash type device for supporting the candle. The leash device is constructed from a yet flexible material where one end slips under the window sash and the other around the candle.

Finally, U.S. Pat. No. 4,839,784 to Lin shows a pivoting candle assembly incorporating a suction cup for supporting the candle. The candle can pivot at a single point with the base which allows the candle to remain vertical regardless of the orientation of the surface to which the base is stuck via the suction cup.

SUMMARY OF THE INVENTION

The invention described in this application is a device for supporting an electric candle on a window sill for visual access from the outside. The device provides a more stable and universal method of maintaining electric candles in window view.

In accordance with the invention, the device comprises a window sash; a horizontally extending base member having a vertically extending wall attached thereto; a handle for attachment to the window sash to assist window opening which interacts with the wall and secures the base to the handle; and a retaining means such as hooks, Velcro, or the like which attaches to the base member and allows the holding device to be used with various types of candles.

The base extends horizontally when installed and is comprised of one end, the contact end, which abuts the window sash and another end, the candle end, which supports the electric candle. The handle is attachable to the window sash and while installed extends upward and outward from the window sash leaving a space for grasping it and causing it to have an inside surface facing the sash. The handle is comprised of a C-shaped grasping member having extensions therefrom which can be attached to the sash. The wall is attached to the base such that the distance from the contact end abutting the sash to the wall-side closest the candle end is substantially equal to the horizontal distance from the inside surface of the grasping member to the sash.

The respective and simultaneous contacts of the wall with the handle and contact end of the base with the window sash causes the base to rest horizontally. While the candle is installed, its weight causes one end of the base to abut the sash while the wall abuts and pushes against the inside surface of the grasping member causing the base and candle to be connected with the handle.

BRIEF DESCRIPTION OF THE DRAWINGS

For the purposes of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
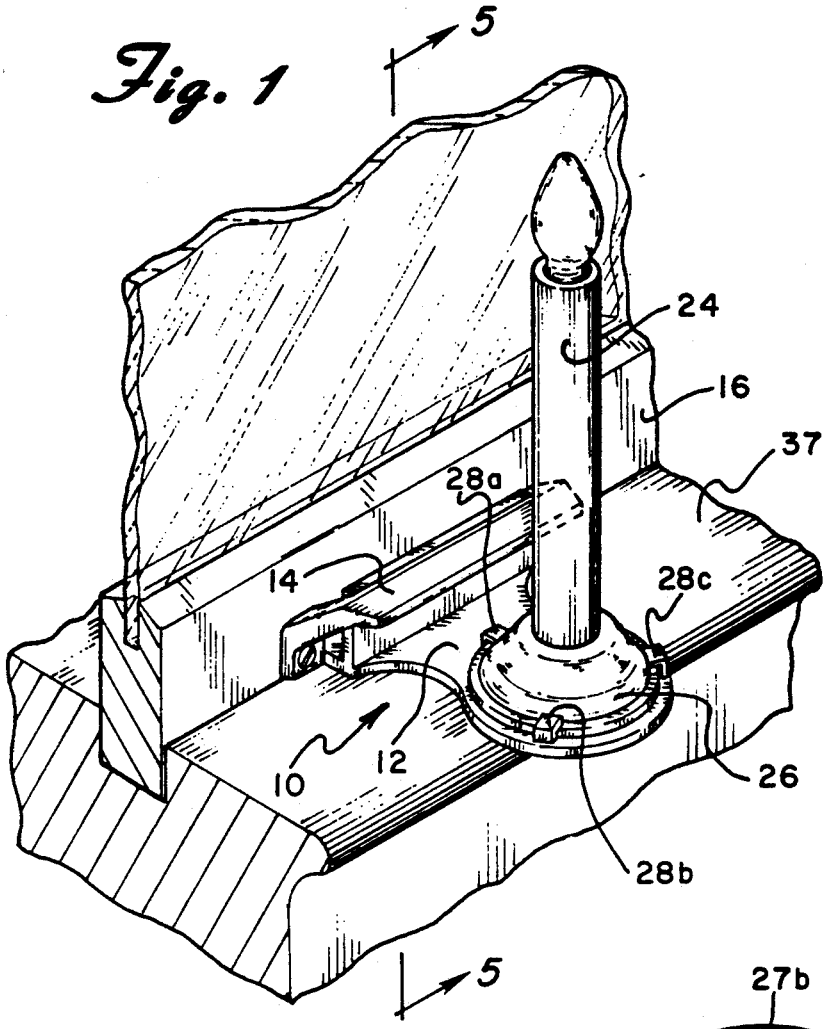
FIG. 1 is a perspective view of the electric candle holder assembly while installed.

Referring now to the drawings in detail wherein like reference numerals have been used throughout the various figures to designate like elements, there is shown in FIG. 1 a perspective view of the electric candle holder constructed in accordance with the general principles of the present invention and designated generally as 10. The electric candle holder 10 is comprised of a support base 12, a handle 14 for attachment to a window sash 16, and a wall 18 attached to the support base 12. The wall 18, being attached to the support base 12, interacts with the handle 14 for securing the holder 10 to the window sash 16.

In the preferred embodiment, the support base 12 is preferably constructed from plastic. While installed, the base 12 extends in a horizontal plane. The base 12 is comprised of a candle end 20 and a contact end 22. The candle end 20 provides the means for attaching an electric candle 24. The candle end 20 is substantially circular in shape and of a diameter large enough to accommodate an electric candle base 26.

Figure 3:
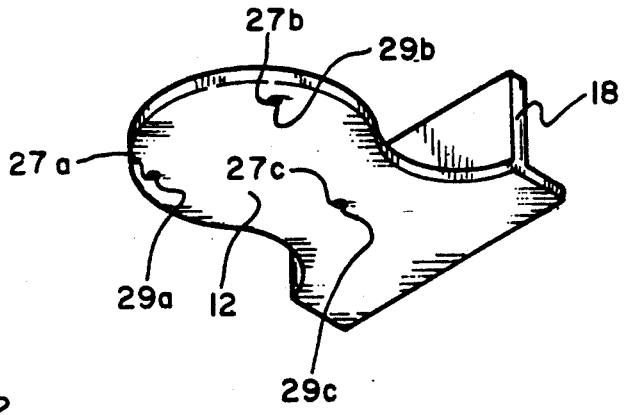
FIG. 3 is a bottom perspective view of the support base showing the hooks force fitted into holes in the base.
Figure 2:
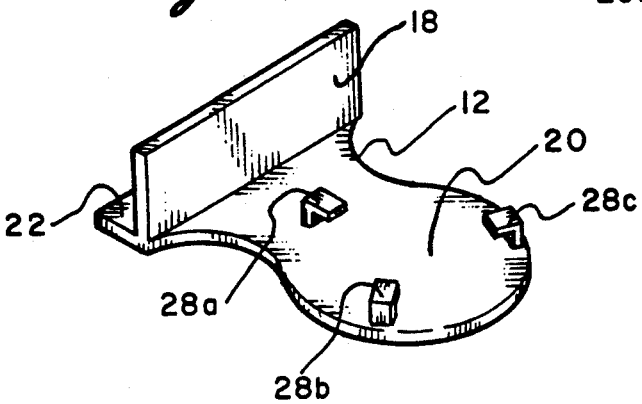
FIG. 2 is a top perspective view of the support base and wall also showing the hooks used for attaching the candle to the base.
Figure 5:
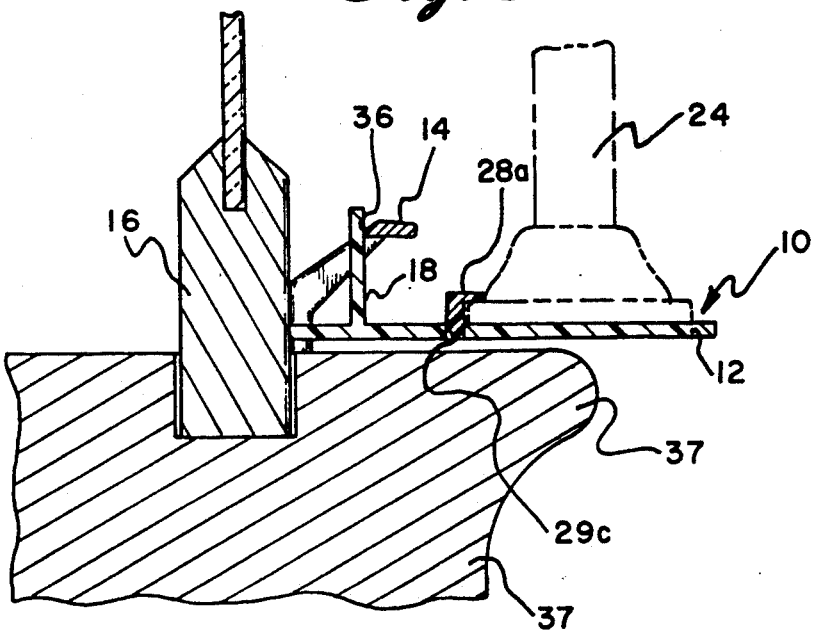
FIG. 5 is a cross sectional side view of the electric candle holder assembly taken through line 5—5 of FIG. 1.

The candle end 20 includes the means for holding the candle base 26 and candle 24 to the support base 12. The preferred method is the use of L-shaped hooks **28*a*, 28*b* and 28*c* attached to the support base 12 at the candle end 20. The hooks 28*a–c* have tapered ends 29*a*, 29*b* and 29*c*, respectively, for insert into holes 27*a*, 27*b* and 27*c*, respectively, in the base 12 at the candle end 20 and extend upward from the support base such that the top of the L faces downward and presses against the support base 12, as shown in FIG. 2, and the bottom of the L faces up and inward. The hooks 28***a–c* are spaced in a circular arrangement at the candle end 20, positioned 120 degrees apart, and are force fit through the holes 27*a–c* in the support base as shown in FIGS. 3 and 5. The candle base 26 is attached via the hooks to secure the candle to the support base 12. A variety of arrangements of the hooks can be accommodated by providing numerous holes in the base in various arrangements which allows for the use of a variety of candle types. The hooks may also be constructed in different sizes for attaining greater heights which can accommodate different size candle types as well. Other methods such as Velcro, adhesive etc., may be used in lieu of the hooks for maintaining the candle to the support base.

Referring to FIG. 5 and toward the contact end 22 of the support base 12, a wall or stabilizer 18 extends perpendicularly from the support base 12. The wall 18 is integrally attached to the support base 12 and interacts with the handle 14 for supporting the assembly.

Figure 4:
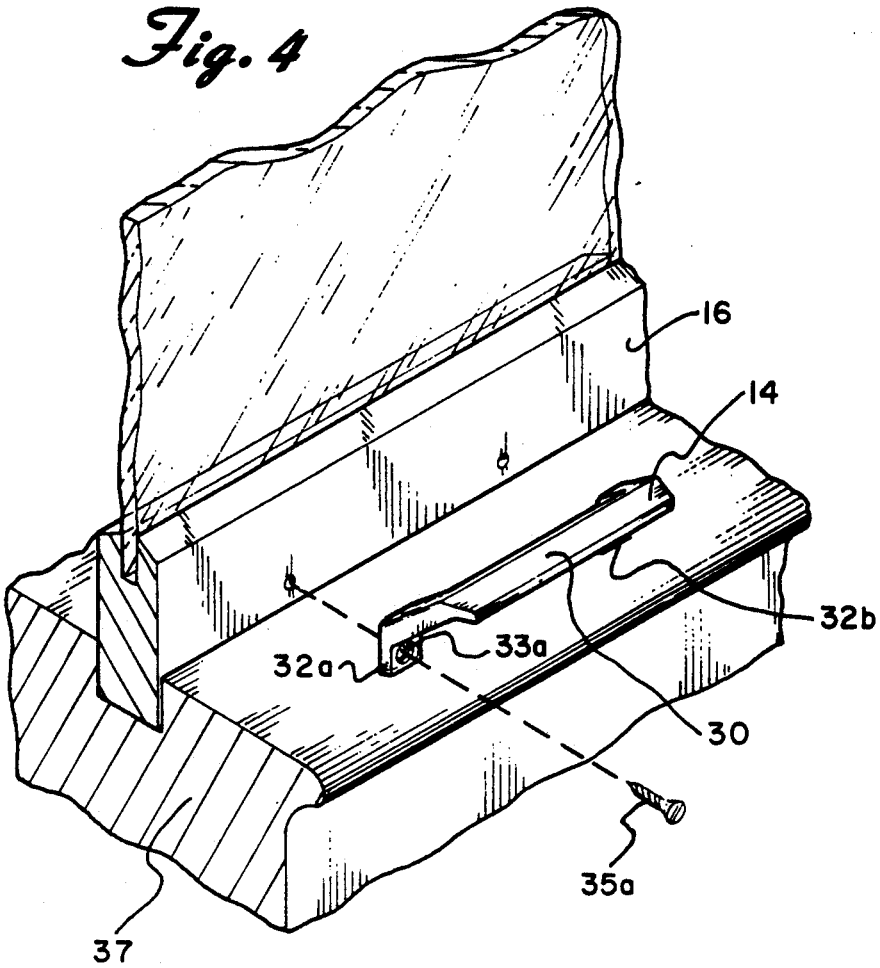
FIG. 4 is an exploded view showing the attachment of the handle to the window sash.

Referring now to FIG. 4 and 5 and to the handle 14, the handle functions both as an aid for opening the window and more importantly to the invention, it is integral in stabilizing the support base and candle to the window. The handle 14 is comprised of the grasping member 30, and the securing members 32*a* and 32*b*. The handle is constructed preferably from a unitary piece of forged or molded metal or other material. The securing members 32*a* and 32*b* are rectangular in shape, extending vertically while the handle is installed, and have a holes 33*a* and 33*b* (not shown), respectively, drilled through each for securing the handle to the window via screws, 35*a* and 35*b* (not shown).

While the handle is installed as shown in FIG. 5, the C-shaped grasping member 30 extends from and between the securing members upward and outward from the window at approximately 45 degrees. The grasping members extends outward enough to allow a hand to grasp it. The grasping member, therefore, has an inside surface 36 which faces the window sash 16.

Referring again to the wall 18 and FIG. 5, the wall side closest to the candle end 20 is located on the support base 12 toward the contact end 22 at a distance equal to the horizontal distance between the inside surface 36 of the grasping member 30 and the window sash 16. Accordingly, upon installation of the support base and candle, the contact end 22, being rectangular in shape, abuts the window sash 16 completely parallel to the sash simultaneous to the wall 18 abutting the inside surface 36 of the grasping member 30. The equal distances cause full tangential abutting of the contact end to the window sash 16 and allows the support base to rest horizontally. By not permanently securing the holder 10 to the window sill 37 and using the weight of the candle and the wall and handle for securing the holder, the holder and candle will remain attached to the window when the window is opened.

The electric candle holder assembly is used by first attaching the handle 14 to the window sash 16 as shown in FIG. 4 by using ordinary wood screws 35*a* and 35*b*. The candle 24 must then be placed on the support base 12 at the candle end 20 and attached thereto using the hooks 28*a–c*. The support base and candle assembly is attached to the window by tilting the candle end 20 of the assembly upward and by inserting the wall 18 into the space between the inside surface 36 of the grasping member 39 and the window sash 16. The candle and support base assembly are then tilted back horizontally until the wall 18 abuts the inside surface 36 and the contact end 22 abuts the window sash 16 in a parallel manner. The assembly could be moved vertically downward and adjusted accordingly until the bottom of the base rests on the window sill 37.

The present invention may be embodied in other specific forms without departing from the spirit or essential attributes thereof and accordingly reference should be made to the appended claims rather than to the foregoing specification as indicating the scope of the invention.

What is claimed is:

1. A device used for supporting an electric candle, comprising:

(a) a window sash;

(b) a handle attached to said window sash and extending substantially outward from said sash; and (c) a base member for supporting an electric candle having a contact end and a candle end, said base member having means for retaining said candle to said base member at said candle end, said contact end abutting against said window sash;

(d) a stabilizing means being attached to said base member and extending upwardly therefrom, said stabilizer being forced against said handle for engaging said handle simultaneous with said contact end abutting said sash for facilitating the securing of said base member and said candle to said window sash.

2. The invention according to claim 1 wherein said base member extends horizontally and said stabilizer extends vertically substantially perpendicular to said base member.

3. The invention according to claim 2 wherein said base member is substantially elongated, said candle end is substantially circular in shape and said contact end is substantially rectangular in shape.

4. The invention according to claim 3 wherein said handle is comprised of two spaced apart mounting members for attaching said handle to said sash and a C-shaped grasping member integral to said mounting members and extending between and outward from said mounting members, said grasping member having an inside surface facing said window sash and spaced therefrom.

5. The invention according to claim 4 wherein said stabilizer is located towards said contact end of said base member, the side of said stabilizer nearest to said candle end of said base member being a distance away from said contact end substantially equal in length to the horizontal distance between said inside surface of said grasping member and said window sash.

6. The invention according to claim 5 wherein said stabilizer is a rectangular wall.

7. The invention according to claim 1 wherein said retaining means comprises hooks attached to said base member at said candle end and extending upward for engaging said candle.

8. The invention according to claim 7 wherein said hooks are L-shaped having tapered ends, said base member at said candle end having holes for force fitting with said ends.

9. A candle assembly comprising:

(a) an elongated candle and a candle holder mounted to the bottom end of said candle;

(b) a substantially horizontally disposed base member having a contact end and a candle end and including means for securing said candle holder to said candle end of said base member;

(c) a window sash and a handle member secured to said sash, said handle member having a portion thereof spaced from said sash and defining an opening between said portion and said sash;

(d) a vertically extending stop member secured to said base member adjacent to but spaced from said contact end; and (e) said contact end of said base member abutting against said sash and said stop member extending into said opening and abutting against said handle.

10. The invention according to claim 9 wherein said base member is substantially elongated, said candle end is substantially circular in shape and said contact end is substantially rectangular in shape.

11. The invention according to claim 10 wherein said handle is comprised of two spaced apart mounting members for attaching said handle to said sash and a C-shaped grasping member integral to said mounting members and extending between and outward from said mounting members, said grasping member having an inside surface facing said window sash and spaced therefrom.

12. The invention according to claim 11 wherein said stop member is located towards said contact end of said base member, the side of said stop member nearest to said candle end of said base member being a distance away from said contact end substantially equal in length to the horizontal distance between said inside surface of said grasping member and said window sash.

13. The invention according to claim 12 wherein said stop member is a rectangular wall.

14. The invention according to claim 9 wherein said retaining means comprises hooks attached to said base member at said candle end and extending upward for engaging said candle holder.

15. The invention according to claim 14 wherein said hooks are L-shaped having tapered ends, said base member at said candle end having holes for force fitting with said ends.

* * * * *